US005311818A

United States Patent [19]

Silvia

[11] Patent Number: 5,311,818

[45] Date of Patent: May 17, 1994

[54] SELF LIMITING EXPLOSIVE LOGIC NETWORK

[75] Inventor: Denis A. Silvia, Aberdeen, Md.

[73] Assignee: The United States of America as represented by the Secretary of the Army, Washington, D.C.

[21] Appl. No.: 874,206

[22] Filed: May 23, 1986

[51] Int. Cl.[5] ..... F42C 19/095

[52] U.S. Cl. ..... 102/200; 102/701

[58] Field of Search ..... 102/200, 221, 275.9, 102/293, 305, 701

[56] References Cited

U.S. PATENT DOCUMENTS

| | | | |
|---|---|---|---|
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 102/275.9 |
| 3,753,402 | 8/1973 | Menz et al. | 102/701 |
| 3,768,409 | 10/1973 | Menz et al. | 102/275.9 |
| 3,973,499 | 8/1976 | Anderson et al. | 102/701 |
| 4,412,493 | 11/1983 | Silvia | 102/701 |

*Primary Examiner*—Charles T. Jordan

*Attorney, Agent, or Firm*—Thomas McDonald; Saul Elbaum

[57] ABSTRACT

An explosive panel, in which detonation is limited to a predetermined area about any point in the panel at which detonation is initiated, consisting of an array of identical interconnected explosive tile assemblies, each including an explosive tile, a peripheral explosive path, and a plurality of connecting links crossing the peripheral path at a destructive crossover. The outer end of each link is connected to the outer end of an adjacent tile assembly link, and the inner end of the link is connected to the tile through a delay trail. Each link is connected to the peripheral paths by explosive diodes which propagate an incoming detonation to the peripheral path on both sides of the link. When any tile assembly is detonated internally, it will propagate the detonation to all adjacent tile assemblies through its connecting links. When a tile assembly is detonated from an adjacent tile assembly through one of its connecting links, the peripheral path will be detonated and cut all other connecting links of the tile assembly, so that the incoming detonation is limited to only that tile.

7 Claims, 4 Drawing Sheets

SELF LIMITING EXPLOSIVE LOGIC NETWORK

RIGHTS OF THE GOVERNMENT

The invention described herein may be manufactured, used or licensed by the Government for Governmental purposes without the payment to me of any royalties thereon.

BACKGROUND OF THE INVENTION

The invention relates generally to explosives and particularly to explosive initiation mechanisms, specifically, self-limiting explosive logic networks.

In some applications, it is necessary to limit the spread of detonation of a sheet or panel of secondary explosive. The explosive panel does not have to be simply connected, and it may have breaks or holes of relatively small size. However, it must be self-limiting no matter where the point of initiation may be. In addition, the explosive panel must meet the usual criteria of being safe, practical and rugged.

It is well known to use explosive logic networks to direct and control the detonation of explosive material. These logic networks may include explosive logic devices utilizing the "corner effect" principle, such as the destructive crossovers and explosive diodes discussed in U.S. Pat. No. 3,753,402, issued Aug. 21, 1973 to Menz et al. These logic networks may also include time delay elements, such as the explosive delay paths discussed in U.S. Pat. No. 4,412,493, issued Nov. 1, 1983 to Silvia.

SUMMARY OF THE INVENTION

It is an object of the invention to provide an explosive panel whereby a detonation initiated at any point in the explosive panel is limited to a predetermined area of the panel about the initiation point.

The explosive panel consists of an array of interconnected, non-overlapping explosive tile assemblies. Each tile assembly includes an explosive tile, an explosive peripheral path extending about the tile but buffered from it, a plurality of explosive connecting links, and a like plurality of identical explosive delay trails connected respectively to the connecting links.

Each connecting link has an inner end connected to the tile through one of the delay trails and an outer end connected to the outer end of a connecting link of at least one adjacent tile assembly. Each tile assembly includes a sufficient number of delay trails and connecting links so that each tile is connected to each adjacent tile by an explosive path consisting of a delay trail and connecting link of one tile assembly connected in series with a connecting link and delay trail of the adjacent tile assembly.

In each tile assembly, each connecting link extends across the peripheral path such that a detonation propagating in either direction along the peripheral path will cut the connecting link without initiating a detonation of the connecting link in the direction of its outer end. Also both portions of the peripheral path on opposite sides of the connecting link are connected to the connecting link by respective explosive paths. These explosive paths, together with the destructive crossover of the connecting link and the peripheral path, serve as explosive diodes to permit a detonation proceeding from the outer end of the connecting link to initiate detonation of the peripheral path in both directions away from the connecting link, and to prevent a detonation proceeding in either direction along the peripheral path from initiating detonation of the connecting link in the direction of its outer end.

When a detonation is initiated in any tile, it will respectively propagate through the delay trails and connecting links of that tile assembly to the adjacent tile assemblies. When an incoming detonation arrives at an adjacent tile assembly, it propagates from the outer end of one connecting link through the connecting delay trail to the tile. It also propagates in both directions along the peripheral path crossing the connecting link. The peripheral path and the delay trails are designed so that before an incoming detonation along one connecting link can propagate through the connected delay trail, the tile, and another delay trail to any other connecting link, the parallel detonation of the peripheral path proceeding in both directions from the one connecting link will have already cut the other connecting link. Thus any incoming detonation to a tile assembly is limited solely to the explosive tile of that tile assembly. When a detonation is initiated at any point in one tile of the explosive panel, it will be limited to that one tile and those tiles immediately adjacent that one tile.

BRIEF DESCRIPTION OF THE DRAWINGS

The invention will be better understood, and further objects and advantages of the invention will become more apparent from the following description of the preferred embodiment taken in conjunction with the drawings in which.

DESCRIPTION OF A PREFERRED EMBODIMENT

The explosive panel described herein includes a plurality of non-overlapping plates or tiles of explosive material which are interconnected by explosive logic circuitry so that a detonation initiated at any point in one tile will be limited to that tile and those tiles immediately adjacent to that tile.

The tile dimensions are selected to produce the desired area of detonation about the tile in which detonation is initiated. Identical tiles are used to achieve identical areas of detonation for any detonation initiation point in the panel. In order to avoid large holes in the panel, the tiles can be restricted in shape to area filling polygons, such as triangles, rectangles, and hexagons. To achieve as near as possible a uniform radius of detonation about an detonation initiation point, the tiles can be further restricted in shape to equilateral polygons, such as the respective arrays of triangular, square, and hexagonal tiles 2,4,6 shown in FIG. 1. In the tile arrays of FIG. 1, the hatched tiles indicate the area of detonation about an initiation tile (shown cross-hatched).

Figure 1:
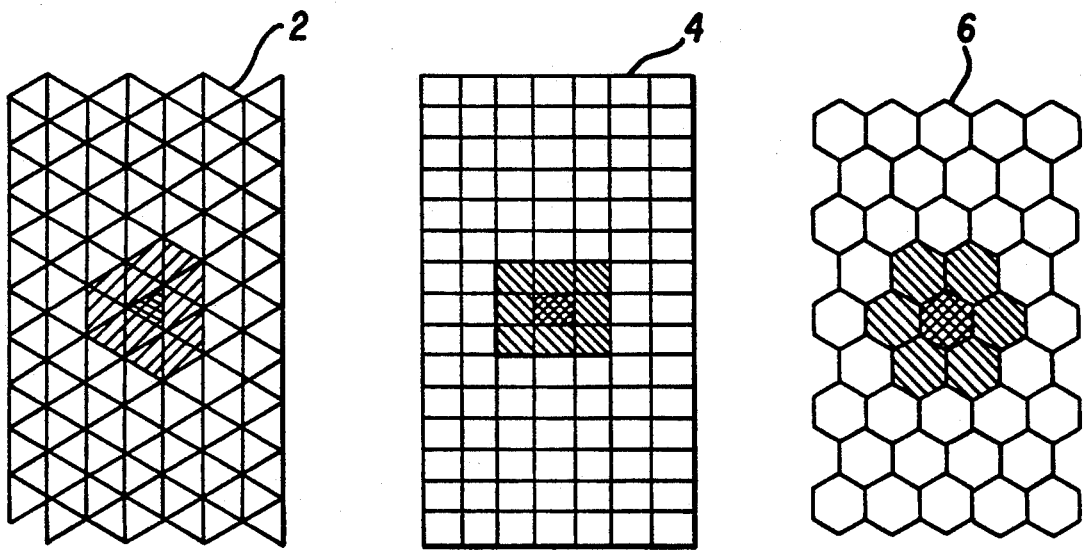
FIG. 1 shows several arrays of identical explosive tiles which may be used in the explosive panel, according to the invention.
Figure 2:
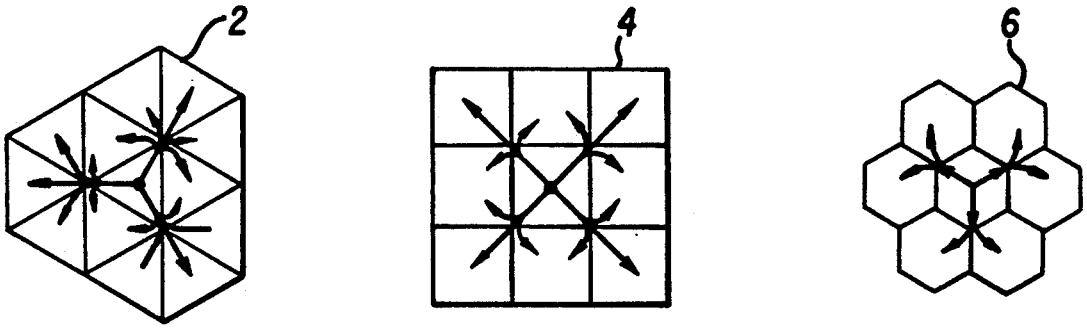
FIG. 2 shows the inter-tile links required for each array of FIG. 1.

The best selection among the three tile shapes of FIG. 1 can be made on the basis of which shape gives the smallest number of inter-tile links, since each inter-tile link is a possible source of failure. FIG. 2 shows that:

1. Each triangular tile array generates a lop-sided area of detonation with three groups of four links each.

2. Each square tile array generates four groups of three links each.

3. Each hexagonal tile array generates three groups of two links each.

The hexagonal array is clearly the preferred embodiment, since it generates only half as many links as the triangular or square arrays. Furthermore, the area of detonation for the hexagonal array more closely approximates a desired circular area than do the two other arrays.

The explosive logic circuitry must be such as to allow each explosive tile to operate in either of two modes:

(1) When the tile is detonated from an interior point, it must propagate the detonation to all adjacent tiles.

(2) When the tile is detonated from an exterior point, it must not propagate the detonation to any other tiles.

The development of the required explosive logic circuitry can best be explained in several steps.

Figure 3:
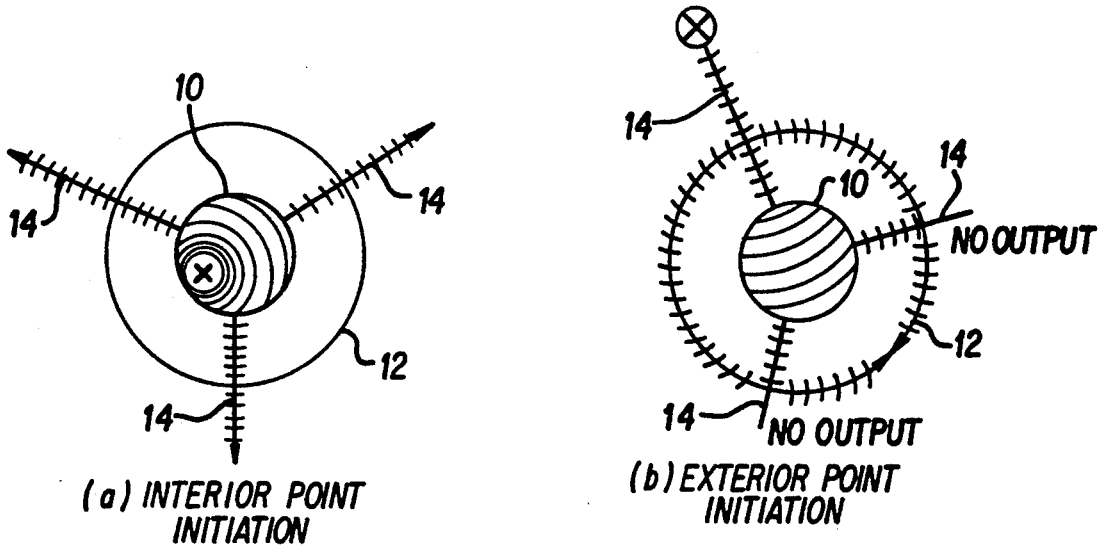
FIGS. 3(*a*), 3(*b*), 4 and 5 are functional diagrams of an individual tile, showing steps in the development of the explosive logic network of the invention.

Suppose each tile is surrounded by a peripheral trail like a belt highway, with the inter-tile connecting links radiating from the tile like spokes from a wheel, across the beltway to the next tile. If any tile is detonated from an interior point, then it will propagate outward along the links to the next tile. It may or may not initiate the beltway as it passes. However, if the tile is initiated from some adjacent tile, then the detonation travels down the inter-tile link, across the beltway and into the tile. If the detonation could also race around the beltway and cut all the links to other tiles, before the detonation could traverse the tile, then the detonation would be isolated. In other words, it will do exactly what it is supposed to do. FIG. 3 shows the functional operation of a tile 10 with beltway 12 and radial links 14.

Figure 4:
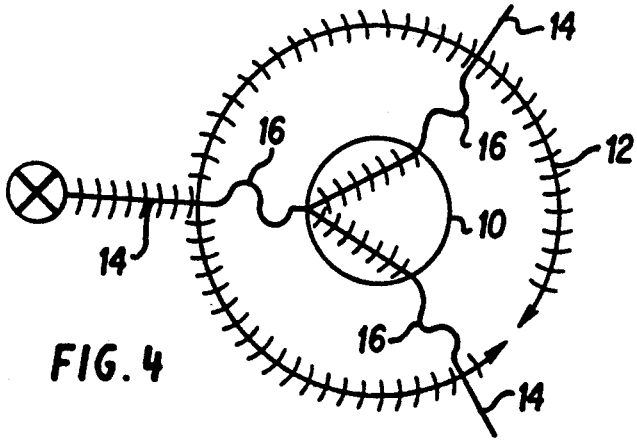

Since the detonation velocity is just as fast for the tile inside as it is for the beltway, we can't just speed the beltway up. It is necessary to slow the tile down. This is done by connecting the links 14, to the tile 10 through respective delay trails 16 disposed between the beltway path 12 and the tile 10. Two delays 16 will be detonated in going from any input link 14, through the tile 10 to any other link 14 on the opposite side. If the sum of these extra delay paths plus the the tile path itself are longer than the beltway trail, then a detonation started outside the beltway will race around to the other links and cut them before the detonation completes the interior path. This is illustrated in FIG. 4, where a detonation entering along a connecting link 14, meets the beltway 12. While the beltway 12 is detonating in both directions, the detonation is also progressing through the delay trail 20 and into the tile 10. Once it has crossed the tile, it will enter the other delay trails, but the prior detonation of the beltway 12 will prevent any detonation from going into other tiles through the other links 14.

Figure 5:
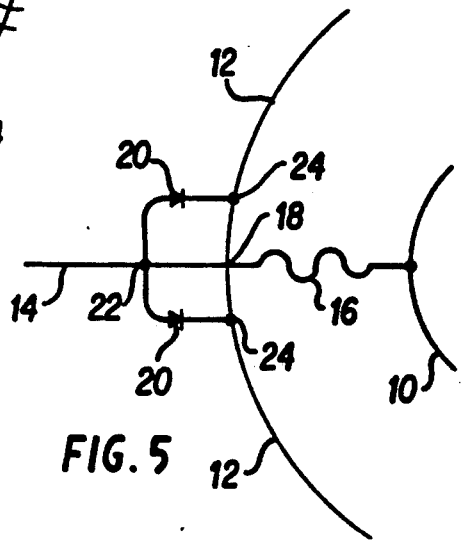

The final step in the development of a self-limiting explosive logic network is to connect the links 14 and the beltway 12 so that the required logic can be performed. Every detonation traveling inward along a link 14 must be propagated to the beltway 12 on both sides of the link 14 as well as to the tile 10. Also, the detonation propagated to the beltway 12 must cut the other links 14 without propagating the detonation outward along the links 14 to the connecting links of other tiles. FIG. 5 shows a functional network to accomplish these logic requirements. In FIG. 5, the connecting link 14 crosses the beltway 12 at a destructive crossover 18, which is constructed to utilize the "corner effect" so that a detonation propagating along the beltway 12 will not propagate outward along the link 14. Two explosive diodes 20 are connected between the link 14 and respective portions of the beltway 12 on opposite sides of the link 14 to allow detonation to propagate from the link 14 to the beltway 12 and to prevent detonation from propagating from the beltway 12 to the link 14. The explosive diodes 20 may be similar to those described in U.S. Pat. No. 3,430,564, issued Mar. 4, 1969 to Silvia et al. No corner effect is utilized at the junction 22 of the beltway 12 and diodes 20 or at each junction 24 between the diode 20 and beltway 14, so that a detonation propagating along the link 14 proceeds through the diode 20 into the beltway 12 as well as through the delay trail 16 into the tile 10.

In the preferred embodiment of the invention, the two explosive diodes 20 are replaced by two simple explosive paths which cooperate with the destructive crossover to perform the same function as the diodes 20, as described below and shown in FIG. 8. Since each explosive diode 20 is a potential source of failure, the elimination of these diodes 20 enhances the reliability of the explosive logic network.

Figure 6:
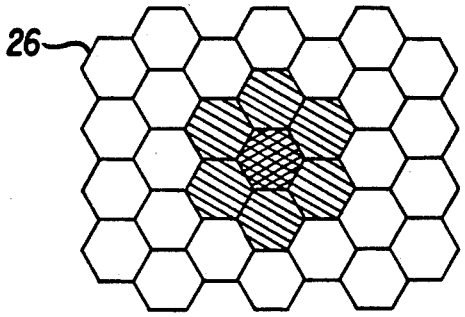
FIG. 6 is a plan view of the preferred embodiment of the invention.
Figure 7:
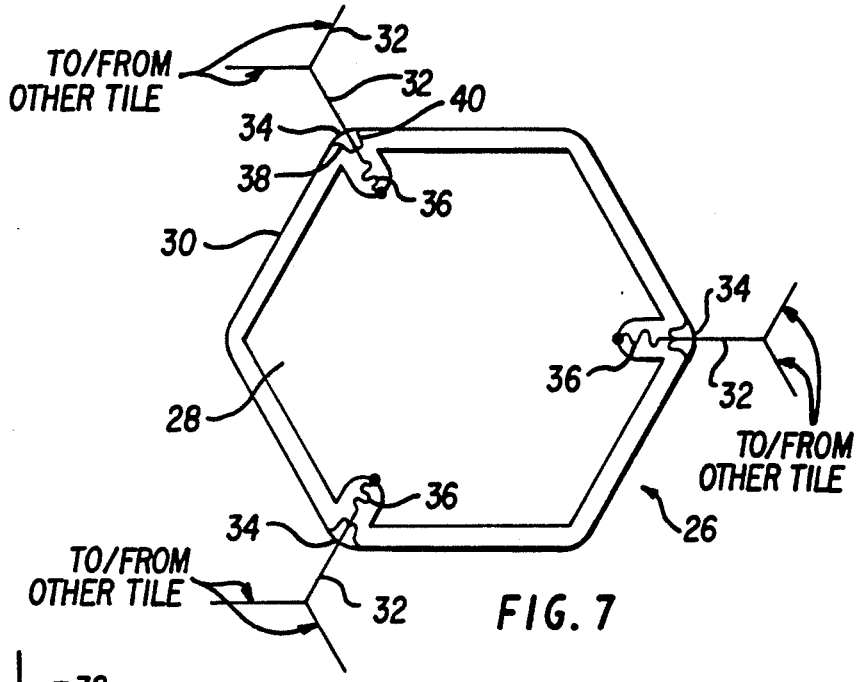
FIG. 7 is a schematic of an individual explosive tile assembly of the embodiment of FIG. 6.

The preferred embodiment of the invention is an array of identical tile assemblies 26 in the nominal shape of regular hexagons, as shown in FIG. 6. Each tile assembly 26 includes a hexagonal tile 28 of explosive material and a peripheral explosive trail or beltway 30 extending about the tile 28 but buffered from it, as shown in FIG. 7. Three radially extending connecting links 32 cross the beltway 30 at respective destructive crossovers 34. The inner ends of the links 32 are respectively connected to the tile 28 by delay trails 36. The outer end of each link 32 is connected to the outer ends of two links 32 of two adjacent tile assemblies 26.

Figure 8:
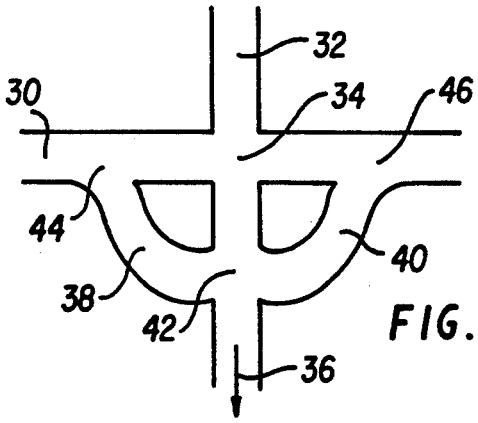
FIGS. 8–11 are schematic representations of a destructive crossover and associated explosive diodes of the tile assembly of FIG. 7, showing various modes of operation of these elements.

Each link 32 is connected to the beltway 30 by two explosive paths 38, 40 on opposite sides of the links 32 as shown in FIG. 8. The junction 42 between the two paths 38, 40 and the link 32 is designed so that any detonation proceeding inwards along the link 32 toward the tile 28 is also propagated in the two paths 38, 40. The junction 44 between the path 38 and beltway 30 and the junction 46 between the path 40 and beltway 30 are designed so that a detonation propagated into link 32 will in turn be propagated along the beltway 30 away from the link 32. Also the two paths 38, 40 are made longer than the portions of the beltway 30 between either junction 46 and the destructive crossover 34 so that any detonation propagating along the beltway 30 will cut and open the link 32 before the same detonation can propagate from the beltway 30 to the link 32 along either path 38, 40.

Figure 9:
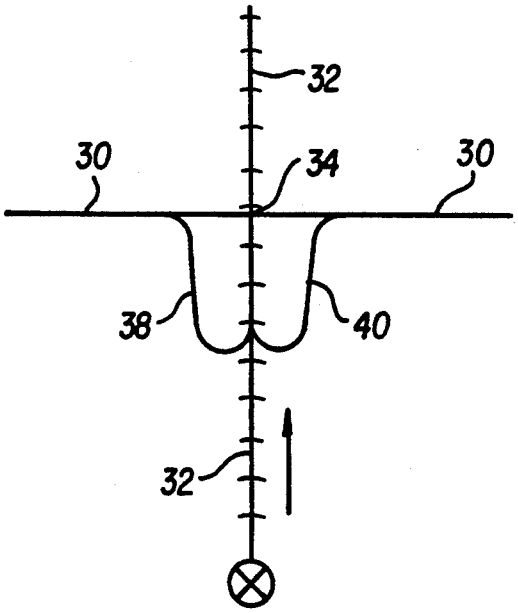
Figure 10:
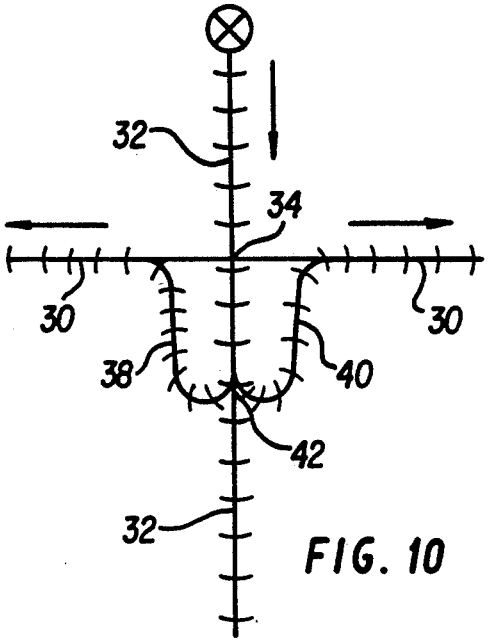
Figure 11:
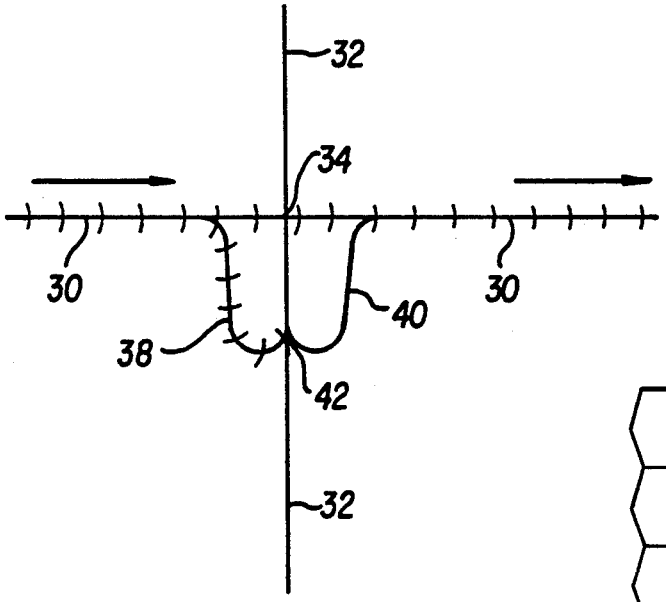

Whenever any point in a tile 28 of any tile assembly 26 is detonated, the detonation will be propagated through the three delay trails 36 into the three connecting links 32. The detonation will propagate outward in each link 32 into respective connecting links 32 of two adjacent tile assemblies 26, as shown in FIG. 9. Thus the detonation will be propagated from the tile assembly at which detonation was initiated (shown cross-hatched in FIG. 6) into the six adjacent tile assemblies (shown hatched in FIG. 6). As the detonation proceeds inwardly along a link 32 of any of the adjacent tile assemblies, it is propagated not only through the delay trail 36 into the tile 28, but also through the two paths 38, 40 into the beltway 30 in both sides of the link 32, as shown in FIG. 10. The beltway 30 and the delay trails 36 are designed so that the detonation will propagate in both directions from the link 32 along the beltway and cut all other links 32 of the tile assembly 26 before the detonation can be propagated from the link 32 into the tile 28 and out any other link 32 of the tile assembly, as shown in FIG. 11. Thus, the detonation is limited to the tile in which detonation is initiated and the immediately adjacent tiles.

Figure 12:
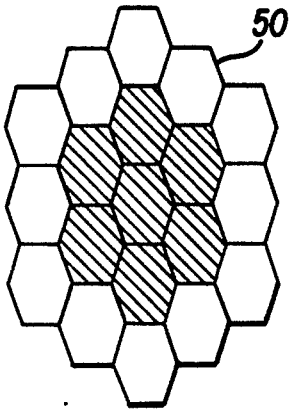
FIG. 12 is a plan view of a variation of the preferred embodiment of FIG. 6.

The preferred embodiment may be altered to tailor the shape of the detonated area for specific needs, for example, FIG. 12 shows a set of hexagonal tile assemblies 50 with a 2:1 distortion in one direction.

Since there are many variations, adaptions and additions to the invention which would be obvious to one skilled in the art, it is intended that the scope of the invention be limited only by the appended claims.

What is claimed and desired to be secured by letters patent of the United States is:

1. An explosive panel including a plurality of interconnected explosive tile assemblies, each tile assembly comprising:

a tile of explosive material;

a peripheral path of explosive material extending about the tile;

a plurality of connecting links of explosive material, each extending from an inner end across the peripheral path to an outer end which is connected to a link outer end of at least one adjacent tile assembly, the number of links being sufficient to connect the tile assembly to every adjacent tile assembly, the intersection of each link with the peripheral path being such that a detonation propagating along the peripheral path will cut and open the link without propagating the detonation outwardly in the link;

a like plurality of explosive logic means, associated respectively with the connecting links, for propagating an incoming detonation to the tile assembly from the associated link to the peripheral path; and a like plurality of explosive delay means, connected respectively between the inner ends of the connecting links and the tile, for delaying an incoming detonation along any link so that the detonation will be propagated about the peripheral path and all other connecting links of the tile assembly will be cut before the detonation can be propagated through the tile to any of the other connecting links.

2. An explosive panel, as described in claim 1, wherein each explosive logic means comprises:

a first explosive diode, connected between the associated link and a portion of the peripheral path disposed on one side of the link, for propagating an incoming detonation along the peripheral path in a direction away from the associated link; and a second explosive diode, connected between the associated link and a portion of the peripheral path disposed on an opposite side of the link, for propagating an incoming detonation along the peripheral path in an opposite direction away from the associated link.

3. An explosive panel, as described in claim 1, wherein each explosive logic means comprises:

a first explosive trail connected at one end to the associated link intermediate the delay means and the crossover of the link and peripheral path and connected at an opposite end to a portion of the peripheral path disposed on one side of the associated link, such that an incoming detonation to the tile assembly is propagated through the first trail and along the peripheral path in a direction away from the associated link, wherein the shortest explosive path between the junction of the first trail with the peripheral path and the crossover of the associated link and peripheral path is along that portion of the peripheral path extending therebetween; and a second explosive trail connected at one end to the associated link intermediate the delay means and the crossover of the link and peripheral path and connected at an opposite end to a portion of the peripheral path disposed on an opposite side of the associated link, such that an incoming detonation to the tile assembly is propagated through the second trail and along the peripheral path in a direction away from the associated link, wherein the shortest explosive path between the junction of the second trail with the peripheral path and the crossover of the associated link and peripheral path is along that portion of the peripheral path extending therebetween.

4. An explosive panel, as described in claim 1, wherein the explosive tiles are identical in size and shape.

5. An explosive panel, as described in claim 4, wherein the explosive tiles are shaped as area-filling polygons.

6. An explosive panel, as described in claim 5, wherein the explosive tiles are shaped as hexagons.

7. An explosive panel, as described in claim 6, wherein each tile assembly not disposed on the periphery of the panel comprises three connecting links, each connected to one connecting link of one adjacent tile assembly and one connecting link of another adjacent tile assembly.

* * * * *